US005362051A

United States Patent [19]

Swafford, Jr. et al.

[11] Patent Number: 5,362,051

[45] Date of Patent: Nov. 8, 1994

[54] ENTERTAINMENT AND PROMOTIONAL METHOD

[75] Inventors: John W. Swafford, Jr., Lombard; William P. Carlson, Aurora, both of Ill.

[73] Assignee: RTC Industries, Inc., Chicago, Ill.

[21] Appl. No.: 114,009

[22] Filed: Aug. 30, 1993

[51] Int. Cl.[5] ..... A63F 9/00

[52] U.S. Cl. ..... 273/138 A

[58] Field of Search ..... 273/138 A, 139, 85 C; 235/380, 487

[56] References Cited

U.S. PATENT DOCUMENTS

| | | | |
|---|---|---|---|
| 4,854,590 | 8/1989 | Jolliff et al. | 273/138 A |
| 5,007,641 | 4/1991 | Seidman | 273/138 A |
| 5,080,364 | 1/1992 | Seidman | 273/138 A |
| 5,269,522 | 12/1992 | Chagoll et al. | 273/138 A |

*Primary Examiner*—William H. Grieb

*Attorney, Agent, or Firm*—Dressler, Goldsmith, Shore & Milnamow, Ltd.

[57] ABSTRACT

A promotional method comprising the steps of storing a predetermined number of recognizable data, storing a message for each of the predetermined number of recognizable data, scanning a document to read machine readable information appearing thereon, determining whether scanned data represented by the machine readable information on the scanned document represents data corresponding to any of said stored recognizable data, identifying the stored recognizable data corresponding to the scanned data in response to the determination that the scanned data corresponds to one of the stored recognizable data, identifying a stored message associated with the identified stored recognizable data, and selecting the identified message and producing an output response corresponding thereto.

10 Claims, 3 Drawing Sheets

A

ENTERTAINMENT AND PROMOTIONAL METHOD

FIELD OF THE INVENTION

The present invention relates to entertainment and promotional methods including those involving the processing of data on documents and producing appropriate responses thereto.

BACKGROUND OF THE INVENTION

A variety of systems have been proposed for use in promotional activities, such as giving awards, for the purpose of inducing patrons to purchase items or enter business establishments. Typically, promotional systems are designed to attract patrons to a business establishment by necessitating a patron's presence as a condition of eligibility for the award, the idea being that a prospective patron at the establishment has the opportunity to acquire the product or services being offered. The benefit to be obtained by the utilization of such promotional systems, therefore is to attract customers.

The basic operation of such promotions is to award selected prizes or benefits to prospective patrons entering the establishment. One problem with such systems is the method by which prospective patrons can determine their eligibility and obtain the appropriate prize or award. One technique that has been utilized is to issue printed coupons or other indicators identifying the benefit to be obtained. For example, printed coupons may be distributed with periodicals or the daily newspaper in which the prize or award is identified. One typical example is a free or discounted second item when a first product or service is purchased.

Significant lead time is usually required in the distribution of pre-printed coupons by mail or as inserts for publications such as magazines or newspapers. Once coupons are printed, the award or benefit is predetermined and fixed. There is little ability to change or modify a promotional program while those coupons are in circulation since there is little, if any, flexibility once the coupons are printed. Often such coupons have an expiration date in order to permit such changes.

It has been proposed therefore to utilize some type of universal or multi-purpose coupon which can be processed upon presentation at an establishment for the purpose of determining the award. Systems have been utilized in conjunction with lottery games in which a ticket can be purchased with the particular combination of numbers or other indications which then can be presented to a machine for the purpose of identifying the particular ticket and determining whether the numbers thereon are eligible to win a prize.

For example, two related patents, Seidman U.S. Pat. Nos. 5,007,641 and 5,080,364 disclose a system for processing information on a token to determine whether the holder of the token is eligible to win a prize. In the Seidman patents, a number or other legend is represented on a token or coupon in the form of a bar code arrangement. The bar code pattern on the coupon is scanned by a system located in the establishment and the number represented thereby is identified. The tokens disclosed in the Seidman patents may take different forms.

When the bar code on one of the tokens in the Seidman patents is scanned by the system, the number represented by the code is compared to one or more stored predetermined numbers to determine whether the number presented is a "winning" number. A "winning" number in a system such as disclosed in the Seidman patents is one which may or may not be eligible for a prize. A potential winning number, one identified as a "winning" number, is not always awarded a prize.

The awarding of prizes in the system disclosed in the Seidman patents is a two-step procedure. Initially, a random selection process selects some of the scanned tokens on which the winning code has been printed. The selection from scanned "winning" tokens determines whether a prize will be awarded. This occurs randomly at the time the token is scanned or presented to the system. If the token is not selected even though it has a "winning" number, no prize or award is made.

Once a token is randomly selected at the time the code thereon is scanned, any of a variety of prizes can be awarded to any of the selected winning numbers.

Thus, the system disclosed in the Seidman patents, processes scanned numbers in substantially identical fashion. The coupons are randomly selected at the time of presentation to receive an award, and the awards to the selected tickets are randomly assigned at the same time.

The system as disclosed in the Seidman patents is intended to prevent fraud. This is achieved by treating all "winning" tokens the same, as indicated above. The random processing of tokens, including the selection and assignment of prizes occurs at the time the tokens are scanned and is not predetermined prior to the presentation of the token. Thus, the random selection and assignment process is initiated in response to scanning the codes on the various tokens as they are presented.

In Jolliff, et al. U.S. Pat. No. 4,854,590, a prize award system is disclosed in association with products being purchased. The scanning of the UPC bar codes associated with the products purchased during check out commences the gaming operation. The resulting number that is generated is compared to a list of winning numbers.

Other approaches utilize pre-existing representations or codes associated with products to determine whether that code number which represents the product and is pre-assigned results in the award of a prize or other promotional indication. Such systems rely on the awareness of customers that there may be a promotion if they arrive at the store. They are not intended to distribute promotional items in an effort to induce potential customers into a facility.

It would be desirable to have a flexible system for implementing a method capable of operating with distributed coupons or other information containing input documents such as, for example, credit cards in order to attract potential patrons to a location for the purpose of inducing such potential customers to enter the place of business or for otherwise promoting products to improve business operations. Such a system and method should desirably have the ability to interact with a variety of information containing input documents, including those which have been previously distributed and at the same time have the flexibility to produce a variety of awards, prizes, inducements or promotions as a result of the presentation and processing of such promotional input documents.

SUMMARY OF THE INVENTION

In accordance with the present invention, there is provided a promotional method for processing information from a variety of input documents, such as coupons or other types of promotional materials, or other existing type information containing input documents such as credit cards and other materials capable of being scanned or sensed, and for awarding prizes or other incentives as a function of the information on the input documents or promotional items. A method in accordance with the present invention is capable of receiving and reading a document or other promotional item, such as a coupon, and extracting information therefrom. In one typical example, such documents will incorporate machine readable information, such as an optically readable bar code. When documents with machine readable information thereon are presented to an apparatus operating in accordance with the present invention, information is extracted therefrom.

Such an apparatus is selectively responsive to such machine readable information, for example, only to selected types of such machine readable information, and may further be responsive to only selected information of the same type.

In accordance with an aspect of a method incorporating the present invention, the machine readable information which produces a response corresponds to selected stored information. For example, when the machine readable information takes the form of an optical bar code pattern, apparatus incorporating the method of the present invention may respond to only a selected type of bar code, and may be further limited to respond to only certain selected bar code patterns which represent data, such as numbers, that correspond to data stored.

When machine readable information such as a bar code corresponding to the stored information is sensed, a response is produced in accordance with the sensed information or data. A plurality of selected responses may be stored for each different code or machine readable information sensed.

When the machine readable information on an input document corresponds to the information to which the system incorporating the present invention is designed to respond, a selected one of the stored messages corresponding to the sensed data is extracted, and the corresponding response is produced.

A method in accordance with the present invention is capable of and is intended to respond to a selected plurality of different input data in the form of machine readable information and to produce a different selected response in response to the detection of each different one of the selected input data identified. The flexibility of the method is enhanced by the capability of altering responses to each item of identified data as a function of a variety of selectable and controllable conditions.

Thus, in accordance with the present invention, for one or more items of machine readable data identified, a response can be produced as a function of predefined or selectable conditions. Responses can be determined or altered as a function of various conditions existing when the input document bearing the data is presented or machine readable data identified, such as the date, the day of the week, the time of day, or a combination thereof. Other selectable conditions might include the location at which the item is presented, and the number of documents bearing the same data presented within a selected time interval. Thus, while a substantially large number of similar or identical machine readable documents can be produced, the sensing of machine readable information on any one of those documents may elicit different responses as a result of different conditions that have been established and as a function of the existence or absence of various combinations of those conditions.

Thus, a method in accordance with the present invention is capable of providing a wide variety of flexible responses to each different item of the input data identified, as a function of a variety of different conditions, which conditions themselves can be varied without altering or replacing the machine readable documents which are used to provide input information.

In addition, a method in accordance with the present invention is capable of retaining information respecting system operation and other system information, and providing outputs to facilitate use and monitoring of system operation. Such information may be permanently retained or alternatively automatically or selectively cleared to permit selective auditing and reporting of such data relating to system operation.

More specifically, in one form of a promotional method incorporating the present invention, documents bearing suitable machine readable data such as a bar code are presented and scanned by appropriate scanning and input circuitry capable of reading and extracting information from the machine readable data. If the information represented by the scannable machine readable data such as the bar code corresponds to stored data, it is identified, and the stored information corresponding to that data item such as a code number is extracted from memory in accordance with a number of selectable conditions that may have been established.

The information extracted may vary for each stored item of data, such as a number, or only for some of the different stored data as a function of the various conditions established. The response to some input data may vary as a function of one or more conditions such as the time at which the document is presented, the date on which it is presented, or the location or identity of the apparatus to which the document has been presented. The response to other input data may vary as a function of a different combination of such conditions or other conditions such as the number of prizes or numbers corresponding to the particular data which previously has been processed at the location or within a predetermined time interval. The response to additional input data may not vary as a function of any condition. Furthermore, the responses and the conditions may also vary.

A response corresponding to the information extracted as a function of the input data and the preselected conditions is produced in a form that is recognizable by a customer or the person who has presented the original document. For example, an audible and/or visual message can be produced to advise the customer who presented the document of the outcome of the promotion resulting from the presentation. Concurrently, a printed record can also be produced which may be useable by the customer for obtaining the award or promotion or which may also be used in processing awards and/or prizes.

The capability of the method can be enhanced by utilizing some type of replaceable control, e.g., a replaceable data storage component, by which the data which produces responses can be changed. The output extracted as a result of the presentation and recognition of such input data can also be changed and/or the conditions and control thereof modified.

Information about system operation can be stored and retained for later retrieval. Such information can be used to monitor system operation, to audit the type of input documents presented and the data on such input documents, as well as to monitor prizes awarded and the conditions existing when input documents are sensed or scanned. For example, the quantity of each type of input document presented and the data sensed can be identified and stored. The conditions existing, e.g., time and date, when different types of input documents are presented can be monitored. A record of the number of each of the stored messages and corresponding prizes awarded can be maintained. These are examples of the type of system information that can be stored for later retrieval and use.

Thus, the method and apparatus incorporating the present invention is capable of processing a wide variety of documents automatically, and of processing the machine readable information represented on or by those documents to produce a variety of outputs or responses. The outputs or responses can change as a function not only of the information represented by the document but also as a function of a number of selected conditions which may vary and/or which may be altered by the operator or establishment.

The awards and promotional capabilities of a method incorporating the present invention are enhanced by the flexibility of operation while simultaneously permitting a wide variety of approaches to be adopted in conjunction with the selection and utilization of promotional materials and distribution thereof to customers and potential customers in order to maximize the benefits obtained from use of the method.

Numerous other features and advantages of the present invention will become readily apparent from the following detailed description of the invention and an embodiment thereof, from the claims, and from the accompanying drawings in which the details of the invention are fully and completely disclosed as a part of this specification.

DETAILED DESCRIPTION OF THE PREFERRED EMBODIMENTS

Figure 1:
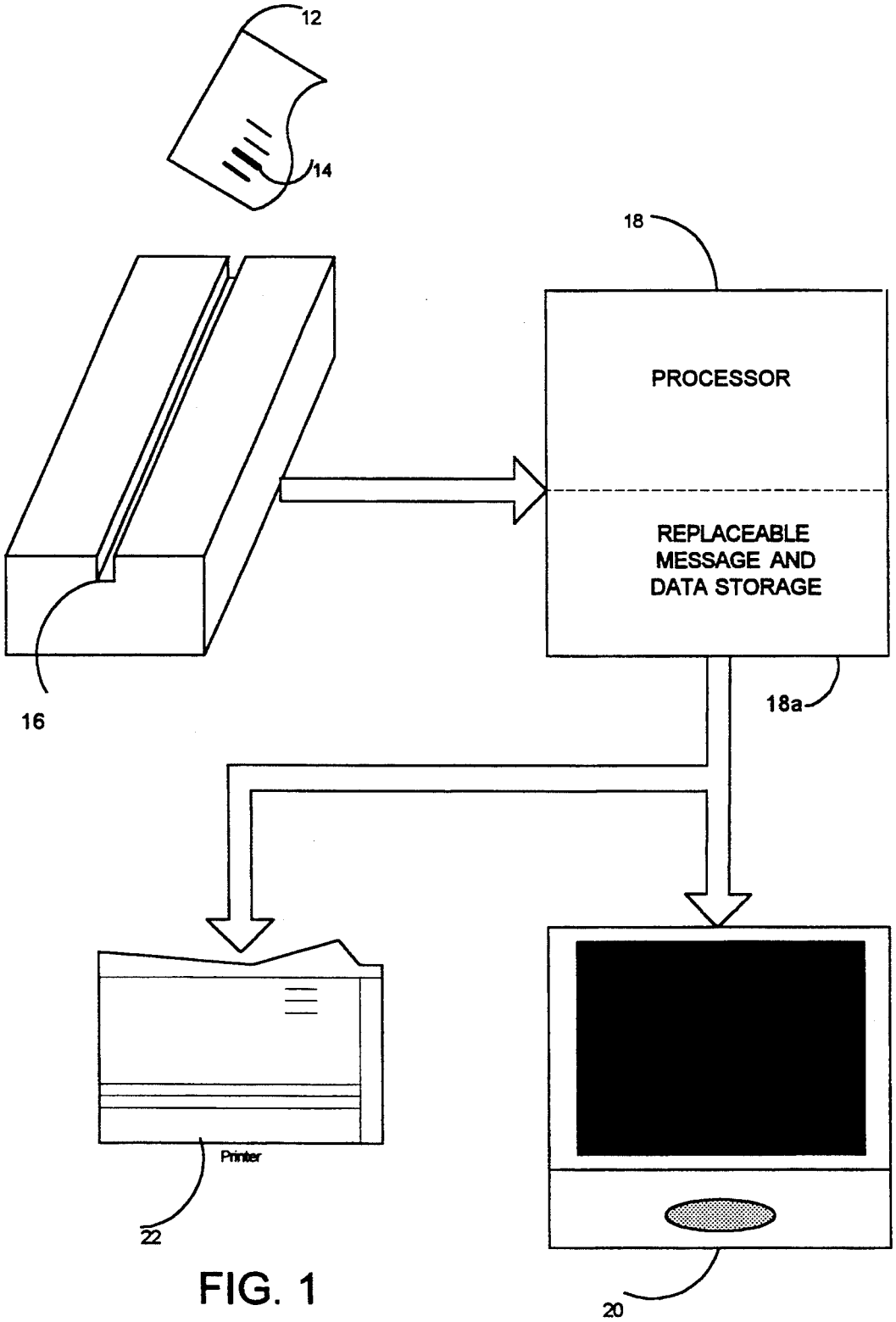
FIG. 1 is a diagrammatic view of an apparatus for implementing the method incorporating the present invention; and FIGS. *2a* and *2b* together are a flow chart showing various steps in the operation of the method incorporating the present invention.
Figure 2A:
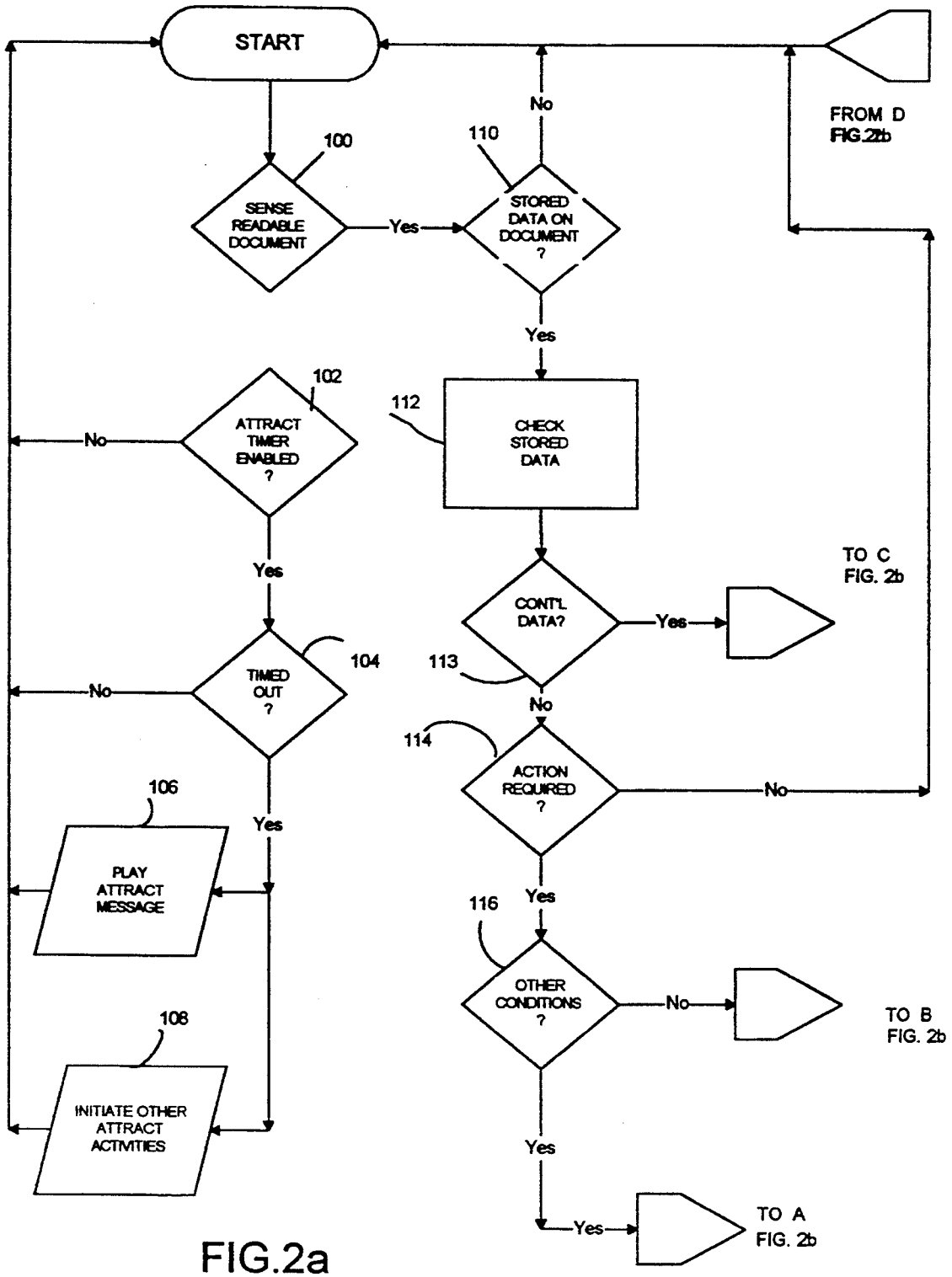
Figure 2B:
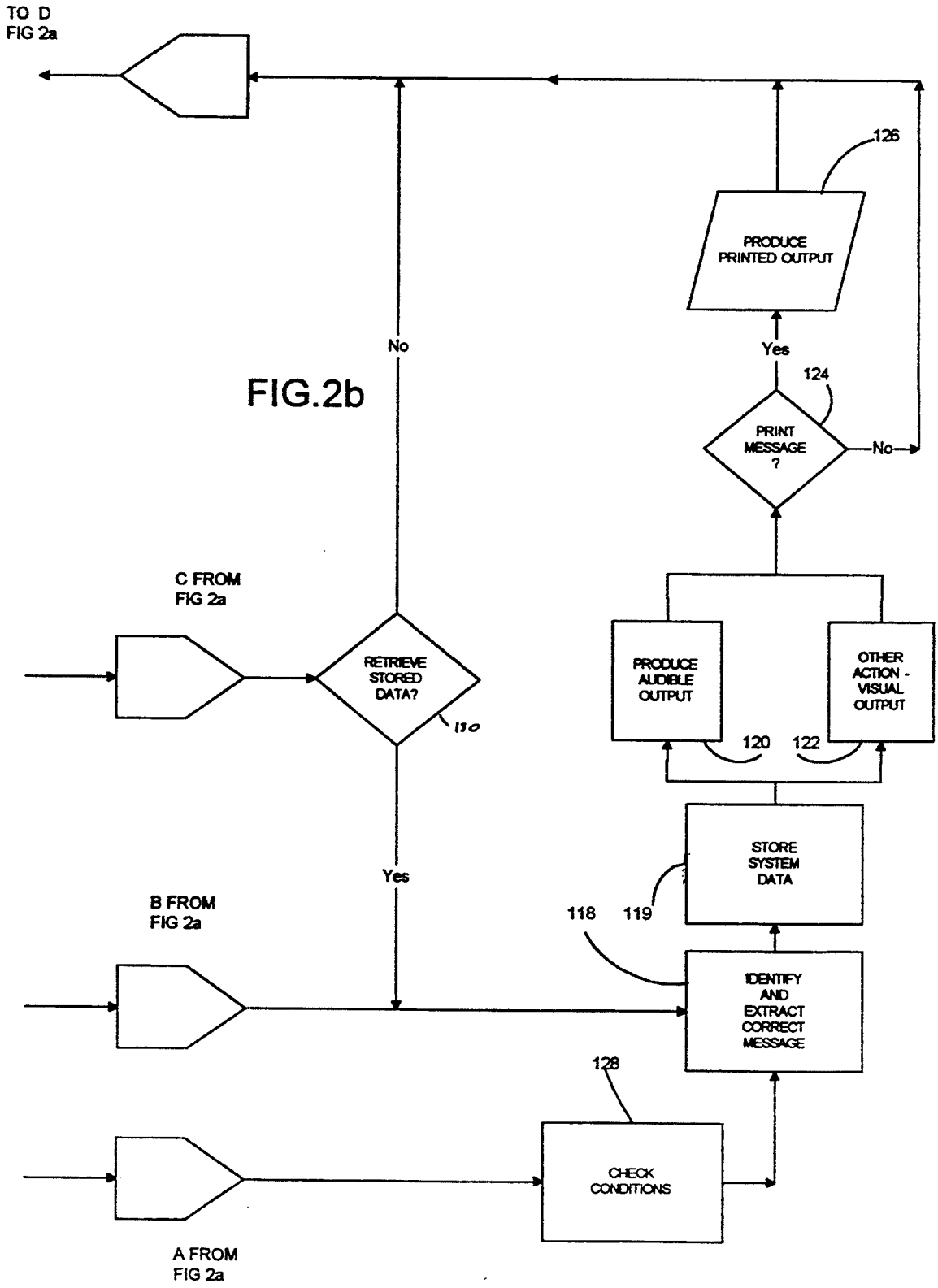

While the present invention is susceptible of embodiment in various forms, there is shown in the drawings, and will be hereinafter described, a preferred embodiment of the invention with the understanding that the present disclosure is to be considered as an exemplification of the principles of the invention and is not intended to limit the invention to the specific embodiments illustrated.

Apparatus incorporating the promotional method in accordance with the present invention, which is intended to attract patrons, is typically located in the establishment to which it is desired to attract patrons. The apparatus is utilized by scanning a document 12, such as a coupon or ticket, containing machine readable information. In the illustrated example, the information on the document or coupon 12 is in the form of an optically scannable bar code 14, with the scannable information representing alpha-numeric data. A method in accordance with the present invention can be set up to respond to various selected ones of existing bar codes.

In accordance with the present invention, the coupon or scannable message bearing document 12 is passed through a scanning slot 16 containing an optical scanner responsive to the selected bar code 14 on the document 12. The processor 18 remains quiescent until and unless one of a number of pre-selected bar codes 14, corresponding to recognizable data stored in a replaceable memory 18*a*, is detected. If the bar code scanned is not one of the pre-selected code numbers or data words stored, the apparatus is reset and awaits the scanning of another document.

If the document or coupon 12 scanned bears a bar code 14 corresponding to and representing information that has been stored, and for which the method has been designed to respond, the scanned data is identified, and subject to any conditions associated with the message or response is produced on an audible and/or visual output device 20 and/or a printed response is produced on printer 22.

Referring to the flow chart of FIGS. *2a* and *2b*, the sensing of a document is checked at 100 to determine whether a readable document has been passed through the scanner. If no document is detected, the existence of an attract timer is checked at 102. If no attract timer is enabled, the system returns to the start. If the attract timer is enabled, the timer is checked at 104 to determine whether the timer has timed out. If the timer has not timed out, the system returns to start. If the timer has timed out, the timer is reset, and the appropriate attract activities such as a message, flashing lights, or other activity is performed at 106 and 108 before returning to start.

If a readable document has been sensed at 100, the data in the form of the bar code 14 on the document 12 is checked at 110 to determine if there is data on the input document. If not the system returns to start without responding. The data is checked at 112 against the data stored in memory 18*a*. If the data corresponds to information stored in memory, and if system monitoring is implemented, the system checks at 113 to determine whether the data is control data, or whether system information retrieval is to be performed. If the data or bar code 14 on the scanned document 12 is not control data and does correspond to information stored in memory, but no response is required at 114 as a result of the stored data having been checked at 112, the system returns to start.

If a response is required, the stored information is checked at 116 to determine whether other conditions are to be checked. If other conditions are not to be checked, the message is identified at 118, system information is stored at 119, the message is extracted from memory, and an audible and any other action set in the system is initiated at 120 and 122. It is then determined at 124 whether a printed message is to be produced, and if so, such a message is produced at 126. Alternatively, a marking on the sensed document to mutilate the bar code can also be implemented.

Examples of additional conditions to be checked, include the time of day, day of week, date, or the number of previously scanned documents, and the number of prizes previously awarded within a selected time period. The condition is identified at 128 and compared to the existing situation. For example, if the apparatus was installed in a restaurant, a particular scannable coupon may produce different responses and corresponding messages as a function of the time of day, one message during morning or breakfast hours, another message during mid-day or lunch hours, and a third message in the dinner or evening hours. Such an arrangement would be particularly appropriate for restaurants, when the output is the award of a food item. The prize could differ for the meal being served at the appropriate time of day.

Another condition might be the day of week, or date, the identity of which could alter the message to be produced in response to the scanning of a particular coded data. In fact, some coded information could result in the award of a prize for a particular time period, not only as a function of the time of day, but the date or day of the week, and be a non-winning prize number during other periods. Such an arrangement would encourage patrons to respond within certain time periods as indicated on the document 12 or on materials associated with the promotion, prior to expiration of the promotion and/or diminution of the possible prize awards.

Upon a determination of all of the conditions applicable to particular information scanned, an appropriate message is identified at 118. The output display 122 is energized and/or an audible response 120 is produced. An appropriate printed message 126 may also be produced. A printed output could take the form of an award coupon to be presented to the establishment for the prize award.

If control data is sensed on the input document (or another control input is utilized), the system checks to determine whether stored data is to be retrieved at 130. If not the system returns to start. Otherwise the selected data is identified and retrieved, and an appropriate output is produced.

In accordance with a method incorporating the present invention, printed output can be produced on a separate document or can be imprinted on the scanned document itself. By imprinting an appropriate message on the scanned document, the readability of the bar code on the document can be impaired to prevent duplicate presentations of the same document for an award. The printed message may also incorporate time limits for presentation of the award certificate for receipt of the intended award.

The method incorporating the present invention is thus very simple, and has flexibility to permit its use in a variety of circumstances. The flexibility of the method, in spite of the fact that scannable coupons or input documents may exist or be available for an extended period of time, allows the response to be varied as a function of selected conditions, such as time, day of week, or date. Other conditions might be an identity of the scanning device establishment in which it is installed, thereby tailoring the program to regions or even individual establishments. Thus awards and responses can be varied while permitting the use of the same coupons or documents in a national promotion. Altering the responses to any coupon as a function of a variety of conditions permits the use of the same coupon in a variety of different establishments since different selected conditions can be established for different installations.

Thus, there has been disclosed a promotional method intended for use in a variety of circumstances, but requiring the participation of potential patrons at the location in which the apparatus is installed. The award of prizes, or other responses occurs as a result of the participation of the patrons at the installation in a variety of ways. The same installation can produce different results in response to a variety of different conditions that have been selected, e.g., time, location, day, or date. Other conditions which can be identified, such as, for example, the total quantity of documents with a particular code that has been scanned at a particular installation during the promotion or within a selected time period could be used to alter the award and response.

In addition the system is capable of storing and retrieving system control data to monitor and audit system information to assist in assuring proper operation of the system and to allow for desired adjustments if appropriate.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the appended claims.

What is claimed is:

1. A promotional method comprising the steps of:

storing a predetermined number of recognizable data;

storing a plurality of different messages for each of the predetermined number of stored recognizable data;

scanning a document to read machine readable information appearing thereon;

determining whether scanned data represented by the machine readable information on the scanned document represents data corresponding to any of said stored recognizable data;

identifying the stored recognizable data corresponding to the scanned data in response to the determination that the scanned data corresponds to one of the stored recognizable data;

identifying the plurality of stored messages associated with the identified stored recognizable data;

selecting one of the identified messages and producing an output response corresponding thereto.

2. A method as claimed in claim 1 wherein said output response is a printed record representative of the selected one of the stored messages.

3. A method as claimed in claim 1 including the step of producing an additional output response as an audible message representative of the selected one of the stored messages.

4. A method as claimed in claim 1 including the steps of selecting one of the identified messages in response to a set of preselected conditions associated with said identified stored recognizable data.

5. A method as claimed in claim 4 including the steps of storing different patterns of preselected conditions for different ones of the stored recognizable data, and producing different messages for each of said identified stored recognizable data in response to different preselected conditions.

6. A method as claimed in claim 4 wherein one of said conditions is the time of day the document was scanned; and including the steps of identifying the time of day the document was scanned; and selecting the one of the identified messages corresponding thereto.

7. A method as claimed in claim 4 wherein one of said conditions is the number of documents previously scanned containing scanned data corresponding to stored recognizable data; and including the steps of identifying the number of documents previously scanned containing scanned data corresponding to stored recognizable data; and selecting the one of the identified messages corresponding thereto.

8. A method as claimed in claim 1 including the step of determining the time interval between the presentation of documents to be scanned; and producing a special message in response to said time interval exceeding a selected value.

9. A method as claimed in claim 1 including the step of storing system information system operation for subsequent retrieval.

10. A method as claimed in claim 9 including the step of producing a special message representative of the stored system information.

* * * * *